United States Patent [19]

Krolik

[11] 3,967,617

[45] July 6, 1976

[54] MECHANICAL GUM MASSAGER

[75] Inventor: Paul P. Krolik, Chicago, Ill.

[73] Assignee: Alston, Inc., Elmhurst, Ill.

[22] Filed: Apr. 7, 1975

[21] Appl. No.: 565,816

Related U.S. Application Data

[63] Continuation-in-part of Ser. No. 526,740, Nov. 25, 1974, abandoned.

[52] U.S. Cl. ..... 128/36; 128/62 A

[51] Int. Cl.[2] ..... A61H 1/00; A61H 7/00

[58] Field of Search ..... 128/36, 62 A, 67, 44

[56] References Cited

UNITED STATES PATENTS

| | | | |
|---|---|---|---|
| 2,016,597 | 10/1935 | Drake | 128/62 A |
| 2,093,006 | 9/1937 | Chott | 128/67 |
| 2,141,969 | 12/1938 | Benz | 128/62 A |
| 2,187,077 | 1/1940 | Erickson | 128/62 A |
| 2,282,700 | 5/1942 | Bobbroff | 128/62 A |
| 2,788,000 | 4/1957 | Lather et al. | 128/62 A |
| 3,183,538 | 5/1965 | Huebner | 128/62 A |
| 3,466,689 | 9/1969 | Aurelio et al. | 128/62 A |
| 3,535,726 | 10/1970 | Sawyer | 128/62 A |
| 3,563,233 | 2/1971 | Bodine | 128/62 A |
| 3,667,454 | 6/1972 | Prince | 128/62 A |

*Primary Examiner*—Lawrence W. Trapp
*Attorney, Agent, or Firm*—Dressler, Goldsmith, Clement & Gordon, Ltd.

[57] ABSTRACT

A mechanical gum massaging device in which the stimulating or massaging element is caused to move (a) in a generally elliptical path, with (b) the plane of said path being substantially perpendicular to the longitudinal axis of the device, and (c) the operative portion of the stimulator element extending outwardly from the device in a direction such that the plane containing said direction and the longitudinal axis of the device is substantially perpendicular to the major axis of said generally elliptical path.

23 Claims, 22 Drawing Figures

FIG. 7
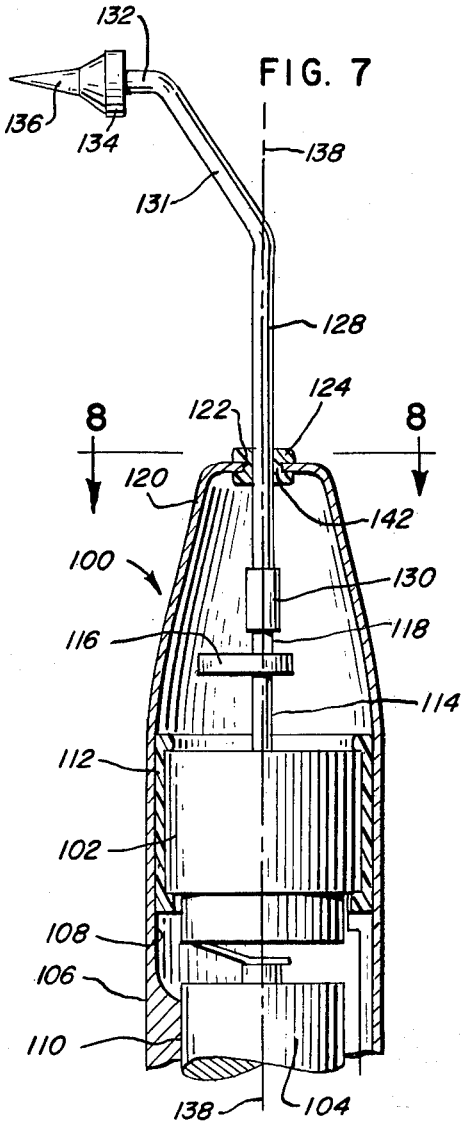
FIG. 8
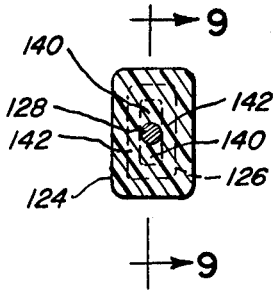
FIG. 10
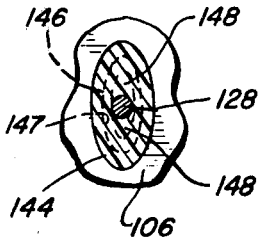
FIG. 9
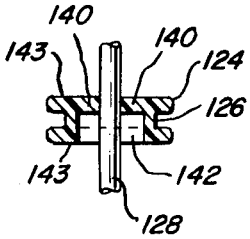
FIG. 11
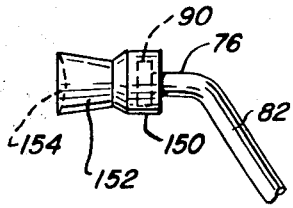
FIG. 12
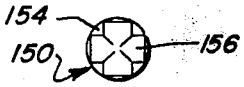
FIG. 13
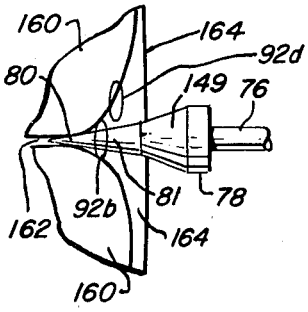
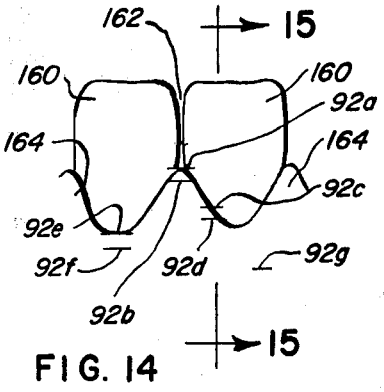
FIG. 14
FIG. 15
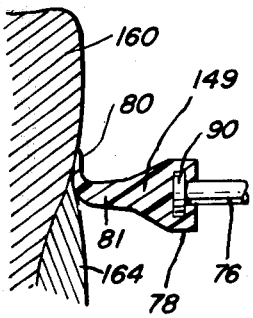

MECHANICAL GUM MASSAGER

This application is a continuation-in-part of my copending application entitled "Mechanical Gum Massager" filed Nov. 25, 1974 and assigned Ser. No. 526,740, now abandoned.

This invention relates to a mechanical gum massaging device.

BACKGROUND OF THE INVENTION

The massaging of the gums of the mouth is extremely important to persons of every age. Vigorous but controlled massaging stimulates circulation of the blood within the gums, and maintains them in a strong, healthy state. Massaging of the gums, together with efficient cleaning of the exposed surfaces of the teeth, helps among other things to avoid the serious condition known as pyorrhea, which is an inflammation of the sockets of the teeth usually leading to loosening of the teeth.

If the gums of the mouth are not maintained in a healthy condition, it may become necessary to cut the gums back surgically. In extreme cases, it may become necessary to extract the teeth, if the gums become so deteriorated through lack of proper attention as to no longer support the teeth properly.

A variety of mechanical gum massaging devices has been known for many years. The type of movement of the stimulating or massaging element in these devices falls in several different categories. Each of these categories has disadvantages, and fails to achieve the most effective massaging action of the gums.

U.S. Pat. No. 955,339 issued to Lumsden on Apr. 19, 1910 discloses a mechanical massaging device which can be used for massaging the gums of the mouth if appropriate stimulating or massaging elements are employed, even though there is no reference in the patent to this specific use. In this device, the force-applying element is caused to follow a circular path in a plane perpendicular to the surface being treated. Because of this type of movement, if the device is held stationary the stimulating element would be spaced from the gum surface under treatment most of the time, and in contact with that surface only where the circular path is tangent to the gum surface. The result would be, in other words, only intermittent contact of very brief duration between the massaging element and the gum surface being treated. In fact, the contact would be so brief, and the distance travelled by the stimulator element away from and towards the gum surface would be so great, that the resulting contact would approach in effect a series of "trip hammer" blows that would be likely actually to damage the gums instead of stimulating them. French patent No. 1,216,838 published Apr. 27, 1960 discloses a mechanical toothbrush that has the same circular action as the Lumsden device — as well as the same disadvantages as that device — if handle 8 in FIG. 1 and handle 24 in FIG. 3 are circular in cross section.

The patent to Groff U.S. Pat. No. 1,833,967 issued Dec. 1, 1931 discloses a mechanical toothbrush in which there is continuous contact between the bristles of the brush and the teeth, as the brush rotates, for that portion of the circumference of the assemblage of bristles that is in contact with the teeth. If the bristles are soft, little massaging effect will result. On the other hand, if the bristles are relatively stiff and this toothbrush is held stationary in one location on the gums for any period of time, the continuous contact of the bristles and the gums could produce an abrasive effect in that small area of the gums. Later patents to Barckley U.S. Pat. No. 3,033,197 issued May 8, 1962 and to Gonzalez U.S. Pat. No. 3,034,376 issued May 15, 1962 disclose mechanically operated brushes that provide a similar type of movement. French patent No. 1,133,470 published Mar. 27, 1957 has a similar rotary brushing action. All these patents have the same disadvantages as the Groff device.

Other patents disclose mechanical devices adapted to brushing the teeth and/or massaging the gums in which the force-applying element maintains continuous and uniform contact with the surface being treated, oscillating back and forth through a relatively small arc. This type of movement provides continuous contact with, and uniform application of force upon, whatever small portion of the surface being treated is included within the travel of the oscillating element. It thus provides no period during which that small portion of the surface is free of massaging or brushing force or even subjected to forces of periodically varying magnitude. In addition, since the direction of application of force is diametrically reversed every half cycle of the oscillatory movement while the magnitude of the force remains the same, these devices do not produce a massaging action having a dominant component in any consistent direction. As a consequence, these devices have a low resultant massaging force, and could actually produce abrasion instead of stimulation of the gums. The patents to Blair U.S. Pat. No. 2,135,933 issued Nov. 8, 1938, Bobbroff U.S. Pat. No. 2,282,700 issued May 12, 1942, Demanuele U.S. Pat. No. 2,977,614 issued Apr. 4, 1961, and FIGS. 1–6 of Huebner patent U.S. Pat. 3,183,538 issued May 18, 1965 provide examples of such devices.

The patents to Lasater U.S. Pat. No. 2,206,726 issued July 2, 1940 and Buck U.S. Pat. No. 2,319,205 issued May 18, 1943 disclose mechanical toothbrushes which are referred to as providing both a tooth cleaning function and a gum massaging function, but which actually operate to produce an even more drastic "trip hammer" effect upon the surface being treated than do the Lumsden patent and French patent No. 1,216,838 discussed above. In these patents, the stimulator element is caused to vibrate back and forth through an oscillatory path that is generally elliptical in shape, with the major axis of the ellipse being oriented in the direction of application of massaging force. This causes the stimulator element to strike the teeth and gums with a continuous series of quite sharp, intermittent blows. Use of this type of device necessarily exposes the user to the potentially damaging effect of any series of hammer blows upon the gums of the mouth.

Still another type of tooth cleaning and gum massaging device is disclosed in the patent to Gregoire U.S. Pat. No. 2,808,602 issued Oct. 8, 1957, the patent to Miller U.S. Pat. No. 3,012,263 issued Dec. 12, 1961, British patent No. 899,618 issued to Peyron with a publication date of June 27, 1962, and FIGS. 5–12 and 17–21 of the above mentioned patent to Huebner U.S. Pat. No. 3,183,538. These devices provide continuous rotary contact of a brushing, massaging or drilling element with the surface being treated. Even when an element otherwise suitable for massage is employed, this form of contact fails to produce the most desirable massaging effect, and could in fact have a harmful abrasive effect on the gums.

ADVANTAGES OF THIS INVENTION

The present invention avoids all the disadvantages of the prior art, and by the same token achieves several important advantages. Despite this fact, and despite the long continued efforts to develop an improved gum massaging device, prior to the instant invention no one had suggested the particular type of elliptical movement and resulting massaging effect that are achieved by the mechanical gum massager of this invention.

The device of the present invention is believed to produce substantially continuous contact with the surface being treated. The resulting contact is such that periodically varying pressure is applied to the surface under treatment, with a dominant component in a particular direction. This periodic application of a dominant massaging force in a given direction produces an extremely effective massaging action.

The massaging action achieved is markedly better than can be obtained with any prior art devices. The repetition of massaging force applied substantially continuously but with the dominant massaging force in a single direction produces a more effective massaging action, for example, than does the circular action of a rotating element, or the back and forth scrubbing action of an oscillating element, operating in a single plane parallel or tangent to the surface being treated. Further, the device of this invention avoids the potential damaging effect of a series of hammer blows upon the gums, since it provides a gradual increase and decrease of massaging force applied to the surface being treated, as the massaging force is continuously applied with periodically varying pressure.

SUMMARY OF THE INVENTION

The gum massaging device of this invention comprises a vibratory mechanism suitable for holding in the user's hand and adapted to produce cyclical movement about a longitudinal axis; a vibrating shank secured at one of its ends to the vibratory mechanism, with the other end of the shank tracing a generally elliptical path during use in a first plane perpendicular to the longitudinal axis of the vibrating mechanism; and a stimulator element mounted on the free end of the shank, with the operative portion of the element facing in a direction such that the plane containing that direction and the longitudinal axis of the device is substantially perpendicular to the major axis of the elliptical path traced by the stimulator.

Two specific forms of the gum massaging device of this invention are disclosed. One form utilizes a vibrating shank with a transverse dimension measured in the second plane just mentioned in the direction normal to the longitudinal axis of the vibratory mechanism that is larger than its transverse dimension measured normal to that plane. In the other embodiment, the shank is journaled in a resilient grommet that has a higher coefficient of stiffness in the direction in which the stimulator faces, which direction lies in the second mentioned plane. Both these arrangements of elements transform the cyclical movement of the vibratory mechanism into the particular type of elliptical movement that is the hallmark of this invention.

Various shapes and kinds of stimulator elements can be employed with the gum massager of this invention. Two embodiments are shown and described below.

BRIEF DESCRIPTION OF DRAWINGS

The invention will now be described by reference to the drawing of this application, in which:

FIG. 7 is a fragmentary showing of another embodiment of the device of this invention, partly in side elevation and partly in section;

FIG. 8 is a sectional view of the resilient grommet of the device of FIG. 7, taken generally along line 8—8 in the latter figure;

FIG. 9 is a sectional view of the grommet of FIG. 8, taken generally along line 9—9 in the latter figure;

FIG. 10 is a sectional view similar to FIG. 8 of another embodiment of a resilient grommet useful with a device similar to that of FIG. 7;

FIG. 11 is a side elevational view of another form of stimulator element useful with the device of FIG. 1, shown in place on the vibrating shank of that device;

FIG. 12 is an end elevational view of the stimulator of FIG. 11 seen from the left-hand side of the latter figure;

FIG. 13 is a plan view of the stimulator element of the device of FIG. 1 in use, showing the generally elliptical path that element follows when its outer tip lies in the interdental space between the teeth or at a gingival margin of the teeth;

FIG. 14 is a reduced front elevational view of the two teeth of which portions are illustrated in FIG. 13, showing the path traced by the stimulator element of the device of this invention when in various positions with respect to the teeth;

FIG. 15 is an enlarged cross-sectional view of a tooth and gum surface shown in FIG. 14, taken generally along line 15—15 in the latter figure and with the stimulator element of the device of FIG. 1 or 7 shown in use;

FIGS. 16A through 18A are diagrammatic showings of the paths followed by the stimulator elements of FIGS. 16 through 18, respectively, when somewhat more than minimal force is applied by the user of the gum massagers in question.

DESCRIPTION OF SPECIFIC EMBODIMENTS OF INVENTION

Two main embodiments of the mechanical gum massager of this invention will be described.

Figure 1:
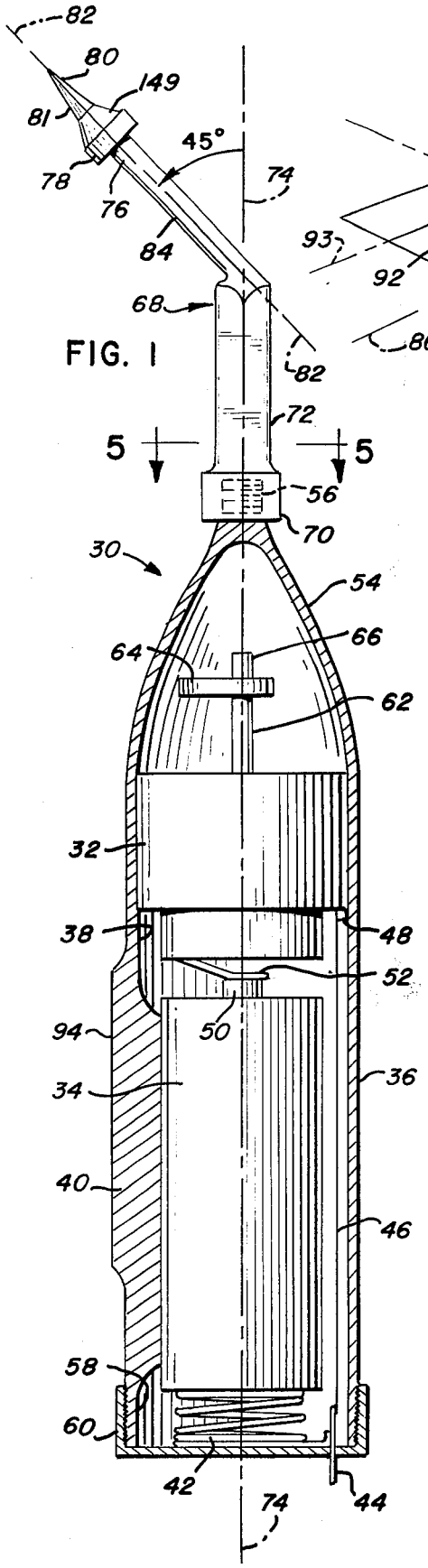
FIG. 1 shows one embodiment of the mechanical gum massager of this invention, partly in side elevation and partly in section.

Embodiment of FIG. 1

In the embodiment of this invention shown in FIG. 1, vibratory mechanism 30 has a drive means that includes electric motor 32, actuated by dry cell 34, both of which are enclosed in casing 36. Casing 36 is an elongated tubular casing suitable for holding in the user's hand. Both motor 32 and battery 34 are rigidly secured to interior wall 38 of the casing. In the case of battery 34, three equally spaced flanges 40 receive the battery when it is slid into place within the casing.

Positioning and negative contact spring 42 holds battery 34 in place. In the embodiment shown, slide switch 44 is connected through lead 46 to one terminal 48 of motor 32. Positive terminal 50 of the battery is connected with the other side of motor 32 through leaf spring contact 52.

Casing 36 is formed of a suitable nonconducting material such as plastic. Its upper end 54 is necked down to terminate in threaded nub 56. Its bottom end 58 is closed by cap 60, through which slide switch 44 extends.

The upper end of electric motor 32 carries rotatable shaft 62 extending outwardly therefrom. A suitable speed of rotation for motor 32 is in the range of about 55 to 70 c.p.s. Eccentric flywheel 64 is carried at the outer end 66 of rotatable shaft 62.

Vibrating shank 68 has flange 70 at the end of its lower portion 72, which in this embodiment is threadably attached to vibratory mechanism 30 through nub 56. Other suitable means of attaching casing 36 and vibrating shank 68 may be employed, and if desired these two members may be integrally formed, as for example by a molding process.

Lower shank portion 72 is positioned with its longidudinal axis generally coinciding with longitudinal axis 74—74 of vibratory mechanism 30. The relative length of lower shank portion 72 with respect to the overall length of vibrating shank 68 may be other than is shown in the drawing, so long as the shape and dimensions of shank 68 as a whole, and the material of which that element is formed, are such that the free end of the shank traces a generally elliptical path as described below.

Free end 76 of shank 68 carries stimulator element 78, which has its operative portion 80, 81 facing upwardly and to the left in the drawing in FIG. 1, in a direction 82 lying in plane 83 (FIG. 2) that also contains axis 74—74.

Figure 4:
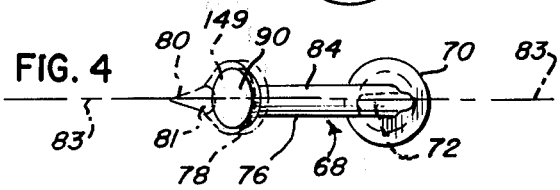
FIG. 4 is a plan view of the vibrating shank shown in FIG. 1.
Figure 5:
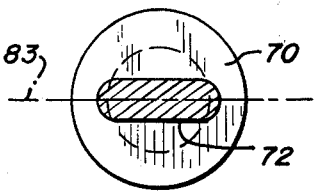
FIG. 5 is an enlarged cross-sectional view of the vibrating shank of the device of FIG. 1, taken generally along the line 5—5 in the latter figure.

As shown in FIGS. 4 and 5, the transverse dimension of portion 72 of vibrating shank 68 measured in plane 83 in the direction normal to axis 74—74 is larger than its transverse dimension measured normal to the plane. Outer shank end 76 and diagonal shank portion 84 may have the same cross section as lower portion 72, a substantially circular cross section, or other cross sectional shape, as desired. In the embodiment shown, diagonal shank portion 84 extends at approximately 135° from lower shank portion 72, to make it more convenient to reach the gums in the back portions of the mouth.

When electric motor 32 is actuated by closing switch 44, the rotation of eccentric flywheel 64 about shaft 62 tends to produce a substantially circular movement in shaft 62 that is transmitted to motor 32. This cyclical movement is in turn transmitted through motor 32 to tubular casing 36, since the casing is naturally held in the user's hand with less than complete rigidity. As a consequence, nub 56 on the casing and bottom end portion 70 of vibrating shank 68 tend also to rotate with circular motion.

Since vibrating shank 68 has considerably smaller transverse cross sectional dimensions than casing 36 and is thus not a rigid body, its outer end 76 does not necessarily trace the same circular path as is followed by its bottom end portion 70. The fact is that because shank portion 72 has a larger transverse dimension in one direction than the other, the circular motion of its bottom end portion 70 will be damped in the direction of the larger dimension when the motion is transmitted upward through shank portion 72. The reason for this is the greater rigidity of portion 72 in the direction of its larger transverse dimension.

As a result, the upper end of shank portion 72 is caused to trace a generally elliptical path in a plane perpendicular to longitudinal axis 74—74, with that elliptical path having a major axis extending perpendicularly to plane 83, and thus also to the direction 82 in which operative portion 80, 81 of stimulator element 78 faces during use of the gum massager. This generally elliptical motion is transmitted through shank portions 84 and 76 to stimulator element 78.

Figure 2:
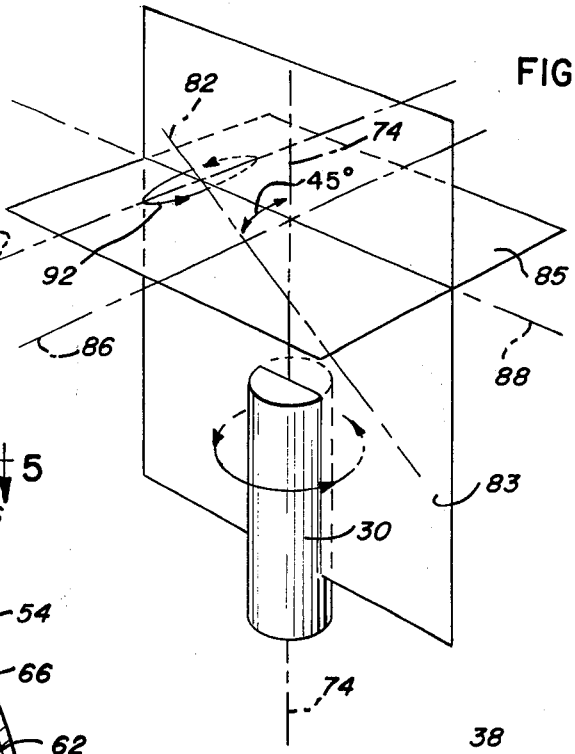
FIG. 2 is a diagrammatic representation of the embodiment of FIG. 1 in perspective view, showing the generally elliptical movement of the stimulator element and the direction in which that element extends outwardly from the device.

FIG. 2 is a diagrammatic representation of the gum massaging device of FIG. 1 in perspective, showing the generally elliptical movement 92 of stimulator element 78 and the direction 82 in which that element extends from vibrating mechanism 30. Longitudinal axis 74—74 of vibratory mechanism 30 is shown, with plane 85 perpendicular thereto. (Axes 86 and 88 are drawn to help define plane 85.) As shown, major axis 93 of elliptical path 92 is perpendicular to plane 83, which contains axis 74—74 and direction 82.

Figure 3:
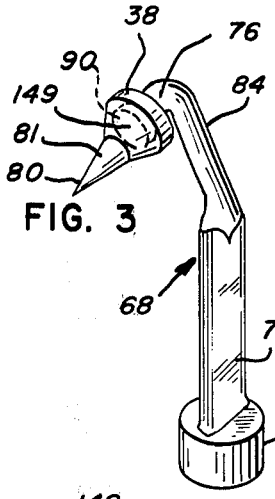
FIG. 3 is a perspective view of a stimulator element mounted on another embodiment of a shank adapted to produce the desired generally elliptical movement of the stimulator element.

FIG. 3 is a perspective view of stimulator element 78 mounted on another embodiment of vibrating shank 68, in which the longitudinal axis of outer end portion 76 is at an angle to shank portion 84 and perpendicular to axis 74—74 of vibratory mechanism 30. The longitudinal axis of stimulator 78 thus coincides with the direction of application of the force resulting from the vibrational movement of the stimulator, although the total force applied to the gums will be the resultant of this force and the force exerted by the user's hand. As shown, stimulator element 78, which is formed of a resilient material such as rubber, fits snugly over expanded end portion or flange 90 at the outer end 76 of the vibrating shank.

FIG. 4 is a plan view of vibrating shank 68 of FIG. 1, with stimultor element 78 shown in phantom. As is seen, lower portion 72 of the vibrating shank has a transverse dimension measured in plane 83 in the direction normal to the longitudinal axis of the device that is several times larger than its transverse dimension in the direction normal to that plane. Diagonal shank portions 76 and 84, however, are substantially circular in cross section in the embodiment shown.

FIG. 5 is an enlarged cross sectional view of shank portion 72 of FIG. 1. This figure again shows that shank portion 72, whose longitudinal axis coincides generally with longitudinal axis 74—74 of vibratory mechanism 30, has a transverse dimension measured in plane 83 in the direction normal to axis 74—74 that is several times larger than its transverse dimension in the direction normal to that plane.

Figure 6:
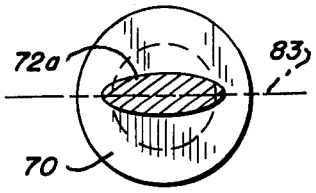
FIG. 6 is a cross-sectional view generally similar to the view in FIG. 5, showing the shank of another embodiment of the device of this invention.

FIG. 6 is a cross sectional view generally similar to the view in FIG. 5, except that shank portion 72*a* has an elliptical cross section.

Although good results can be achieved with as low a ratio as about 3:1, and improved results when the ratio is about 4:1, it is believed that optimum results are obtained with the mechanical gum massager of this invention if the length of the major axis of elliptical path 92 is about five times the length of the minor axis of that path, as is suggested schematically in FIG. 2. With too low a ratio between the lengths of the major and minor axes, the approach and withdrawal of the stimulator element to and from the surface of the gums being treated is not as gradual as is desirable; with too high a ratio, the elliptical path is too flat, and the difference in magnitude between the massaging forces provided in opposite directions parallel to the gum surface is not as large as is desirable.

The response of vibrating shank 68 to the cyclical movement of flange 70 at the bottom end of the shank is not linearly related to the shape or cross sectional dimensions of the shank. For this reason, to achieve a generally elliptical path for stimulator element 78 that is about five times as long in one direction as it is in the other, the cross sectional dimension of shank portions 72 and 72*a* should be about three times as great in the latter direction as in the former (as indicated in FIGS. 5 and 6), when the shank is formed of a moderately stiff plastic material such as cellulose acetate. For a path with a ratio of major axis length to minor axis length of about 3:1, the cross sectional dimensions of shank portions 72 and 72*a*, when they are formed of a moderately stiff plastic material, should be about 1:2.

Casing 46 carries an indicator 94 that is positioned to show the precise direction in which operative portion 80, 81 of stimulator element 78 faces during use of the gum massager of this invention (FIG. 1). Indicator 94 shows the direction in question either when the device is examined by visual observation or when the outer surface of casing 36 is felt by the user as he holds the device in his hand. The latter fact makes it possible for the user to tell simply by his sense of touch how to hold the gum massager with stimulator element 78 facing in the desired direction, when the stimulator element is not visible because it is concealed in the user's mouth.

Embodiment of FIG. 7

FIG. 7 gives a fragmentary showing of another embodiment of the device of this invention.

Vibratory mechanism 100 has a drive means that includes electric motor 102 and dry cell 104, both of which are enclosed in casing 106. Casing 106, like casing 36 of the embodiment of FIG. 1, is an elongated tubular casing suitable for holding in the user's hand. Battery 104 is rigidly secured to interior wall 108 of casing 106 by three equally spaced flanges 110, which receive battery 104 when it is slid into place within the casing.

In this embodiment, motor 102 is resiliently secured to interior wall 108 of casing 106 through rubber sleeve 112. Rotatable shaft 114 extends outwardly from the upper end of electric motor 102. Eccentric flywheel 116 is carried at the outer end 118 of the rotatable shaft.

Casing 106 is formed of a suitable nonconducting material such as plastic. Its upper end 120 terminates in shank-receiving opening 122, in which resilient grommet 124 is seated snugly.

FIGS. 8 and 9 are cross sectional views showing the construction of grommet 124. This grommet is formed of resilient material such as rubber. Groove 126 in the periphery of the grommet is adapted to be snugly seated in shank-receiving opening 122 in casing 106.

Grommet 124 is adapted to fit snugly around vibrating shank 128, which has a substantially circular cross sectional shape and is rigidly attached through sleeve 130 to outer end 118 of rotatable shaft 114 of electric motor 102. The fit of shank 128 in the grommet must be tight enough that it provides a water-tight seal even when the grommet is distorted under pressure during use of the gum massaging device. Grommet 124 in turn is seated snugly, with a reliable watertight fit, in shank-receiving opening 122 of casing 106. Through this construction, water is excluded from the interior of casing 106, in which electric motor 102 and battery 104 are enclosed.

In the embodiment shown, diagonal shank portion 131 extends outwardly from portion 128 and terminates in free end 132, whose axis lies in a plane perpendicular to longitudinal axis 138—138 of vibratory mechanism 100. Stimulator element 134, having operative portion 136, is carried by shank end 132.

Grommet 124 has a higher coefficient of stiffness in one transverse direction than in the transverse direction normal thereto. In FIG. 8, the grommet has a higher coefficient of stiffness in the horizontal direction in the plane of the paper than in the vertical direction in that plane. This is accomplished by forming shank-receiving opening 122 and grommet 124 with a smaller transverse dimension in the direction in which operative portion 136 of stimulator element 134 faces than in the transverse direction normal thereto. In FIG. 8, grommet 124 is narrower in the horizontal direction in the plane of the paper than in the vertical.

Since grommet 124 is formed of resilient material and the walls of casing 106 that define shank-receiving opening 122 are rigid, less restriction is exerted against movement of shank 128 in the direction in which the more extensive mass of resilient material is presented to the shank. Thus, under applied pressure, shank 128 is freer to move in the vertical direction in the plane of the paper in FIG. 8 than in the horizontal direction in that plane. By the same token, under applied pressure, shank portion 128 is freer to move in the plane of the paper than perpendicular thereto in FIG. 9, and just the opposite in FIG. 7.

This effect is heightened with the embodiment of rubber grommet 124 shown in FIGS. 7 to 9 by the fact that grommet portions 140 lying on either side of shank portion 128 in its lengthwise direction are thinner (measured between opposite faces 143 of the grommet), and are therefore more yielding, than are grommet portions 142 disposed on either side of shank portion 128 in the direction of grommet width. See, in particular, FIGS. 7 and 9.

When electric motor 102 is actuated by closing the circuit connecting it to battery 104, the rotation of eccentric flywheel 116 about shaft 114 tends to produce a substantially circular movement in outer shaft portion 118. With motor 102 resiliently mounted in sleeve 112 and with casing 106 held reasonably firmly in the user's grasp, this potentially circular movement of shaft end 118 is transmitted through sleeve 130 to lower shank portion 128.

Because the shape and construction of resilient grommet 124 gives the grommet a higher coefficient of stiffness in one transverse direction than in the transverse direction normal thereto, the potentially circular motion of bottom shank portion 128 will be damped in the direction of greater stiffness. As a result, shank portion 128 is caused to trace a generally elliptical path in a plane perpendicular to longitudinal axis 138—138, with that elliptical path having a major axis extending perpendicularly to the direction in which operative portion 136 of stimulator element 134 faces during use of the gum massager. This generally elliptical motion of shank portion 128 is transmitted through shank portions 131 and 132 to stimulator element 134.

An alternative embodiment 144 of the resilient grommet is illustrated in FIG. 10. In this embodiment, groove 146 is substantially elliptical in shape, and is adapted to be seated snugly in a substantially elliptically shaped shank-receiving opening 147 in casing 106 (of which a fragmentary view is shown in FIG. 10). Taken together, thin grommet portions 148 disposed on either side of shank 128 in the direction of greater flexibility of grommet 144 have a substantially elliptical shape, with shank 128 positioned in the center of the ellipse.

As mentioned above, it is preferred that the length of the major axis of the generally elliptical path traced by stimulator element 134 be about five times the length of the minor axis of that path. In the embodiment of the resilient grommet shown in FIG. 10, because of the nonlinear response of the resilient grommet to applied forces, this shape of elliptical path of stimulator element 134 is achieved if elliptically shaped groove 146 and elliptically shaped shank-receiving opening 147 of casing 106 have major axes that are about two and one-half times as long as their respective minor axes, when grommet 124 is formed of a rubber of medium stiffness. The indicated ratio should be about 1½:1 to produce a generally elliptical path for stimulator element 134 the major axis of which path is about three times its minor axis.

Stimulator Elements

Stimulator elements 78 and 134 (FIGS. 1 and 7) are generally conical in shape, and for increased flexibility preferably have quite a narrow angle of flare at their outer, operative ends. They are formed of a resilient material such as rubber or a suitable plastic.

Extreme end portions 80 and 136, respectively, of stimulator elements 78 and 134 are quite flexible because of their narrow shapes. In element 78, intermediate frustoconical portion 81 has the same flare as extreme outer end 80 but has less flexibility because of its greater diameter or thickness. Resilient base portion 149 likewise has a frustoconical shape, but because it is thicker and also has a wider angle of flare than portions 80 and 81 it is less flexible than those portions. Stimulator element 134 has a shape similar to that of stimulator 78.

Elements 78 and 134 may suitably have diameters of about 3/16 to ¼ inches at their bases, and extend from about ⅜ to ½ inch in length.

FIG. 11 illustrates an alternative embodiment of a stimulator element mounted on flange 90 at the outer end 76 of vibrating shank 68 of FIG. 1. This embodiment 150 is formed of resilient material such as rubber and has a generally cylindrical shape, with a slightly concave surface at its operative end 152. The diameter of surface 154 may be about 3/16 of an inch.

If desired, surface 154 may be provided with grooves or other suitable depressions 156 in which tooth paste or other dentifrice may be contained for application to the teeth when the massaging device is in use (FIG. 12). Because of the resiliency of stimulator element 150, surface 154 and any tooth paste contained in grooves 156 may be applied both to the teeth and to the gums without damage to the latter.

With the embodiment of FIG. 1, threaded nub 56 makes it possible to use stimulator elements 78 or 150, or still other embodiments, interchangeably as desired. Sleeve 130 may also be internally threaded to permit interchangeable use of various stimulators, as desired, with the embodiment of this device shown in FIG. 7.

Use of Gum Massaging Device Of This Invention

Two main embodiments of the mechanical gum massaging device of this invention have been disclosed above. Two stimulator elements, suitable for use with either of the main devices, have also been disclosed. The use of these various embodiments will now be described.

FIG. 13 is a plan view of portions of teeth 160 positioned on either side of interdental space 162. The corresponding gum portions 164 associated with these two teeth are also shown.

Extreme end portion 80 of stimulator element 78 carried by outer end 76 of vibrating shank 68 (FIG. 1) is shown in FIG. 13 inserted between teeth 160 in interdental space 162. In this position, operative portion 80 rests on top of gum 164 and is confined laterally by adjacent teeth 160 on either side. Despite this lateral confinement, because of the flexibility of outer end 80 of the stimulator element, thicker conical portion 81 of the stimulator element tends to follow the same generally elliptical path **92*b* that would be traced as path 92*a* by extreme end 80 if it were not confined between the teeth (path 92 in FIG. 2). Thicker portion 81 is in contact with the gums, and applies massaging force to them, because of the flexibility of outer end 80 and because of the outward flare of stimulator element 78** as one moves away from its outer end.

FIG. 14 is a reduced front elevational view of the two teeth 160 of which portions are shown in FIG. 13, with interdental space 162 between them. Elliptical path **92*a* that would be traced by the extreme end of operative portion 80 of stimulator 78 if it were not laterally confined in interdental space 162 is shown at the top portion of gum 164. Elliptical path 92*b* that is followed by thicker conical portion 81 of stimulator element 78 as it applies massaging forces to gum surface 164 is shown in plan view in FIG. 13 and in front elevation in FIG. 14.**

When stimulator element 78 is moved away from interdental space 162 along the gingival margin of tooth 160 in the right-hand portion of FIG. 14, operative portion 80 of stimulator 78 tends to trace elliptical path **92*c* seen in front elevation in FIG. 14. Whether the entire path is traced depends upon how firmly the end of the stimulator is confined at the juncture between tooth 160 and gum 164. The extreme end of operative portion 80 is so flexible in the embodiment shown that it may be readily bent at right angles to the longitudinal axis of the stimulator, as shown in cross-section in FIG. 15, so that it is effectively restrained — by friction if nothing more — against free hroizontal movement. In any case, because of the shape and flexibility of operative portion 80 of stimulator element 78, the thicker conical portion 81 of the stimulator element is in contact with gum surface 164 and follows elliptical path 92***d*, as shown in plan view in FIG. 13 and in front elevation in FIG. 14.

Elliptical path 92*e* may be followed by the extreme end of operative portion 80 of stimulator element 78 when the stimulator element is positioned at the lowest gingival margin of tooth 160 in the left-hand portion of FIG. 14. In this position, the extreme end of the stimulator is subjected to relatively little positive lateral confinement because of the substantially horizontal plane of the juncture between tooth 160 and its associated gum portion 164. However, the extreme end of operative portion 80 may again be bent over and restrained by frictional forces against free horizontal movement. In any case, as before, elliptical path 92*f* is followed by the thicker conical portion 81 of stimulator 78.

Operative portion 80 of stimulator 78 is usually positioned by the user of the gum massaging device of this invention in an interdental space 162. It is useful, however, as just described, to move the stimulator from time to time along the gingival margins of the teeth. If operative portion 80 of stimulator 78 is inadvertently placed against the main body of the gum tissue, it will generally slide off the gum back into the interdental space or to the periphery of the gum at the gingival margins of the teeth. Any such contact of conically shaped stimulator element 78 with the main body of the gums will not result in any damage to the gums since the extreme end of the stimulator is quite flexible both because of its shape and because of the material of which it is formed.

When a stimulator such as element 150 in FIG. 11 or the modification thereof shown in FIG. 12 is employed, the gum massager may if desired by purposely moved onto the main body of the gum tissue. In this case, operative portion 152 of the stimulator element will trace an elliptical path such as that shown in front elevation at 92*g* in FIG. 14.

Figure 16:
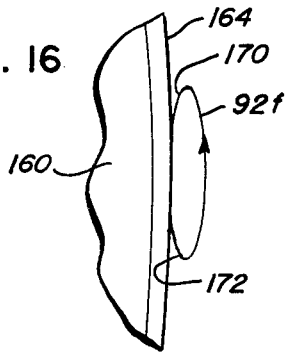
FIG. 16 is an enlarged plan view of the path followed by the stimulator element of the device of FIG. 1 when it is in contact, under the application of minimal force by the user, with the outer surface of the gum being treated.

FIG. 16 gives an enlarged plan view of elliptical path 92*f* that is followed by thicker conical portion 81 of stimulator 78, when the end of the stimulator is positioned at the lower gingival margin near the center of a tooth 160 and follows elliptical path 92*e* as shown in front elevation in FIG. 14. As is suggested by FIG. 16, it is believed that the portions of stimulator 78 that engage gum surface 164 produce substantially continuous contact with that surface, with periodically varying pressure having a dominant component in the downward direction in FIG. 16. This periodic application of a dominant massaging force in a given direction produces an extremely effective massaging action on the area being treated.

The overall amplitude of the vibratory motion measured parallel to the major axis of elliptical path 92*f* in FIG. 16 is suitably about 1/16 of an inch, and the amplitude of elliptical path 92*f* in the direction of its minor axis is considerably smaller. This latter fact, together with the fact that the tissue of gums 164 is yieldable and resilient and the fact that the user of this gum massaging device always exerts some force against the gums when the device is in operation, means that there is rarely any total breaking of contact between the gums and stimulator element 78 during the return portion of the elliptical path that is traced by the stimulator. Nevertheless, it is seen from FIG. 16 that the massaging force applied by the vibrating element 78 will always be greater when the stimulator is moving in the downward direction in the plane of the paper in FIG. 16 than when it is moving in the upward direction. In other words, the result will be (as has been described above) periodic application of a dominant massaging force in a single direction, to wit, downward in FIG. 16. This produces an excellent massaging action — much more effective, for example, than the circular action of a rotating element or the back and forth scrubbing action of an oscillating element (both in a single plane) as in certain prior art devices.

A user of the gum massaging device may prefer to have the dominant massaging force applied to a particular gum area in a certain direction for a few moments, and then in the opposite direction for a few more moments in that same area. Or the user may prefer to have the dominant massaging force always applied in a certain direction in one area of the gums, and always in the opposite direction in another area. To achieve these results, switch 44 may be a conventional reversing switch such as a double pole double throw switch, with the leads to electric motor 32 from the terminals of battery 34 (i.e., lead 46, and a lead wire substituted for leaf spring 52) appropriately connected to the switch. This will make it possible for the user selectively to reverse the direction of rotation of motor 32 and nub 56, which in turn will reverse the direction of travel of stimulator element 78, for example, along generally elliptical path 92 (see FIG. 2), whenever the user desires.

As seen in FIG. 16, stimulator element 78 follows a very gradual approach path 170 as it moves more firmly against the surface of gum 164. By the same token, stimulator 78 follows a very gradual withdrawal path 172 as it pulls away from the gum surface. This provides a gradual increase and decrease of massaging force, as the massaging force is substantially continuously applied as described above, with periodically varying pressure and with a dominant force in a given direction.

Figure 17:
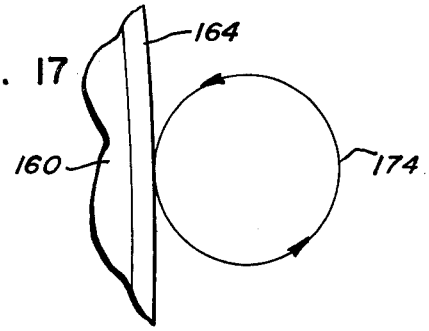
FIGS. 17 and 18 are similar showings of the paths followed by the stimulator elements of certain prior art devices.
Figure 18:
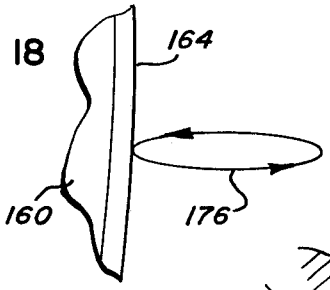

The mode of application of massaging force just described avoids the potential damaging effect of a series of hammer blows upon the gums that results from use of certain prior art devices. FIGS. 17 and 18 provide plan views of the paths followed by vibrating elements of prior art devices, with the maximum amplitude of vibration being in each case the same as the maximum amplitude of vibration shown for the gum massager of this invention in FIG. 16. FIG. 17 shows the circular path 174 followed by the stimulating element in the devices of Lumsden U.S. Pat. No. 955,339 and French patent No. 1,216,838 discussed above. FIG. 18 is a plan view of the elliptical path 176 followed by the stimulator element in the patents to Lasater U.S. Pat. No. 2,206,726 and Buck U.S. Pat. No. 2,319,205, also discussed above.

It is seen from FIG. 17 that the extremely brief contact of the stimulator element with gum surface 164 and the large amplitude of movement toward and away from the gum surface produce in effect a series of "trip hammer" blows that would be likely actually to damage the gums instead of stimulating them. The trip hammer effect upon gums 164 is even greater with elliptical path 176 shown in FIG. 18, since the intermittent blows on the gums are applied by a stimulator element moving through an even more sharply curved path.

Figure 19:
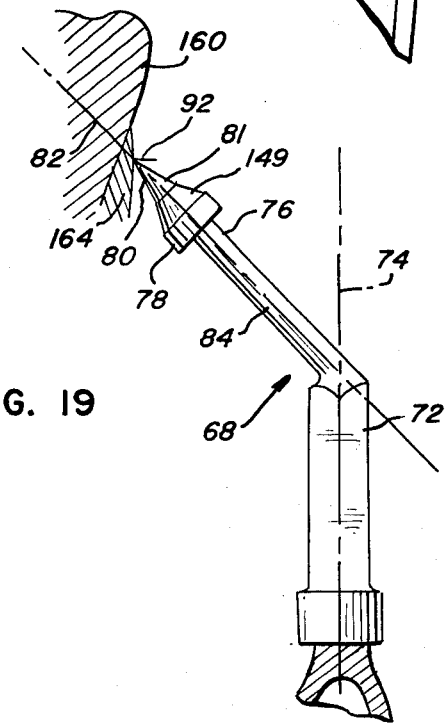
FIG. 19 is a cross-sectional view of a tooth and associated gum surface, with the stimulator element of FIG. 1 shown as it first comes into contact with the surface of the gum.

FIGS. 16 through 18 just described are based on the assumption that the stimulator element of the gum massager of this invention is held against the surface of the gums by the user of the device with only minimal force. For this reason, the paths traced by the stimulator elements are drawn in these Figures substantially as they would appear in free space. In a similar manner, FIG. 19 shows the generally elliptical path 92 (in cross section) that is traced in free space by the operative end of stimulator element 78 mounted on vibrating shank 68 of FIG. 1, as the stimulator element first makes contact with gum 164 below tooth 160.

Figure 16A:
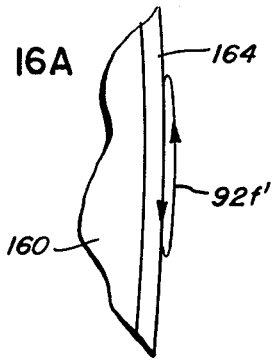
Figure 17A:
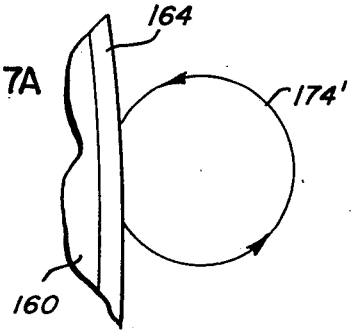
Figure 18A:
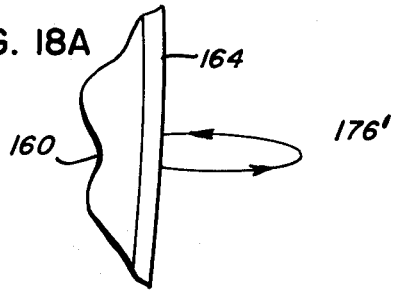

The fact is that when the mechanical gum massagers discussed are in actual use, the free ends of their vibrating shanks will in effect be loaded by the somewhat more than minimal force that will usually be exerted by the user against the gums as the stimulator element is moved across or along the gums. The actual paths followed by the stimulator elements will thus very likely be something like the diagrammatic representations **92*f*', 174' and 176' shown in FIGS. 16A, 17A and 18A, respectively. However, the resulting massaging or hammering action, as the case may be, will still be substantially as has been described for the idealized paths illustrated in FIGS. 16 through 18** that would be traced by the ends of the vibrating shanks as they moved in free space.

It is seen that the gum massaging device of this invention provides a very effective massaging action for the gums of the mouth, and avoids the possibilities of the gum damage that are inherent in prior art gum massaging devices. This is accomplished through the simple and economical construction exemplified in the accompanying drawing and described in this specification and the accompanying claims.

The above detailed description has been given for ease of understanding only. No unnecessary limitations are to be derived therefrom, as modifications will be obvious to those skilled in the art.

What is claimed is:

1. A mechanical gum massaging device which comprises:

a vibratory mechanism suitable for holding in the user's hand and adapted to produce cyclical movement about the longitudinal axis of said mechanism when thus held;

a vibrating shank free at one end and attached at the other end to said vibratory mechanism with a portion of its longitudinal axis generally coinciding with the longitudinal axis of the vibratory mechanism, the transverse cross sectional dimensions of said vibrating shank being smaller than those of said vibratory mechanism, the free end of said shank tracing a generally elliptical path in a first plane perpendicular to the longitudinal axis of said vibratory mechanism when said device is held in the user's hand during operation of the device, said elliptical path having a major axis and a minor axis;

a resilient stimulator element mounted at the free end of said shank, the longitudinal axis of the operative portion of said stimulator element extending outwardly from said vibratory mechanism in a direction such that a second plane containing said direction and the longitudinal axis of said vibratory mechanism is substantially perpendicular to the major axis of said elliptical path, said shank being free of any other stimulator element facing said first mentioned stimulator element in opposed relationship thereto; and means for actuating said vibratory mechanism.

2. The mechanical gum massaging device of claim 1 in which the length of the major axis of said generally elliptical path is about three times the length of the minor axis of said path.

3. The mechanical gum massaging device of claim 1 in which the length of the major axis of said generally elliptical path is about four times the length of the minor axis of said path.

4. The mechanical gum massaging device of claim 1 in which the length of the major axis of said generally elliptical path is about five times the length of the minor axis of said path.

5. The mechanical gum massaging device of claim 1 in which said vibratory mechanism includes drive means, a rotatable shaft extending outwardly from said drive means, an eccentric flywheel carried by said shaft at its outer end, and an elongated tubular casing suitable for holding in the user's hand, said drive means being enclosed by said casing and rigidly secured to the interior wall thereof, the end of said vibrating shank opposite said free end being attached to said casing, and the portion of said shank whose longitudinal axis coincides generally with the longitudinal axis of the vibratory mechanism having a transverse dimension measured in said second mentioned plane in the direction normal to the longitudinal axis of said vibratory mechanism that is larger than its transverse dimension measured normal to said second mentioned plane.

6. The mechanical gum massaging device of claim 5 in which said larger transverse dimension is about two times as large as said transverse dimension measured normal to said second mentioned plane.

7. The mechanical gum massaging device of claim 5 in which said larger transverse dimension is about three times as large as said transverse dimension measured normal to said second mentioned plane.

8. The mechanical gum massaging device of claim 5 in which the shank portion whose longitudinal axis coincides generally with the longitudinal axis of the vibrating mechanism has a substantially elliptical cross section, with the major axis of said elliptical cross section lying in said second mentioned plane.

9. The mechanical gum massaging device of claim 5 in which the end of said vibrating shank opposite said free end is threadably attached to said casing.

10. The mechanical gum massaging device of claim 1 in which the shank portion whose longitudinal axis coincides generally with the longitudinal axis of the vibratory mechanism has a substantially circular cross-section, and said vibratory mechanism includes drive means, a rotatable shaft extending outwardly from said drive means, an eccentric flywheel carried by said shaft, an elongated tubular casing suitable for holding in the user's hand and having a shank-receiving opening, and a resilient grommet having a higher coefficient of stiffness in one direction than in the direction normal thereto and being adapted to fit snugly around said shank, said drive means being enclosed by said casing and being resiliently secured to the interior wall thereof, the end of said shank oppposite said free end being rigidly attached to the outer end of said rotatable shaft, said grommet being seated snugly in said casing opening with said direction of higher coefficient of stiffness lying in said second mentioned plane, and said shank portion being positioned snugly in said grommet.

11. The mechanical gum massaging device of claim 10 in which said shank-receiving opening and the resilient grommet seated therein are both narrower in the transverse direction lying in said second mentioned plane than in the transverse direction normal thereto.

12. The mechanical gum massaging device of claim 11 in which said shank-receiving opening and the portion of the resilient grommet seated therein are both substantially elliptical in shape.

13. The mechanical gum massaging device of claim 12 in which the length of the major axis of said elliptical shank-receiving opening is about two and one-half times the length of its minor axis.

14. The mechanical gum massaging device of claim 12 in which the length of the major axis of said elliptical shank-receiving opening is about one and one-half times the length of its minor axis.

15. The mechanical gum massaging device of claim 1 in which said casing carries an indicator that is positioned to show to the user's touch the precise direction in which the operative portion of said stimulator element faces.

16. The mechanical gum massaging device of claim 1 in which said resilient stimulator element has a generally conical shape.

17. The mechanical gum massaging device of claim 16 in which said stimulator element has an extreme outer end having a conical shape to give said extreme end flexibility, an intermediate frustoconical portion having the same flare as said extreme outer end but less flexibility, and a base portion having a frustoconical shape with a wider angle of flare than said outer end and said intermediate portion.

18. The mechanical gum massaging device of claim 1 in which said resilient stimulator element has a generally cylindrical shape, with the surface of the operative end of said stimulator being slightly concave.

19. The mechanical gum massaging device of claim 18 in which said concave surface is provided with depressions for holding tooth paste or the like.

20. The mechanical gum massaging device of claim 1 which includes means by which the user of the device can selectively reverse the direction of the cyclical movement produced by said vibratory mechanism, whereby the direction of travel of said stimulator element along said generally elliptical path is also reversed.

21. The mechanical gum massaging device of claim 17 in which the longitudinal axis of said stimulator element extends at an obtuse angle to the longitudinal axis of said vibratory mechanism.

22. The mechanical gum massaging device of claim 21 in which said obtuse angle is approximately 135°.

23. A mechanical gum massaging device which comprises:

a vibratory mechanism including drive means, a rotatable shaft extending outwardly from said drive means, an eccentric flywheel carried by said shaft at its outer end, and a tubular casing suitable for holding in the user's hand, said drive means, rotatable shaft, and flywheel being enclosed in said casing with the drive means rigidly secured to the interior wall of the casing, said vibratory mechanism producing cyclical movement about the longitudinal axis of said mechanism when said casing is held in the user's hand;

a vibrating shank free at one end and attached at the other end to said tubular casing with a portion of its longitudinal axis generally coinciding with the longitudinal axis of the vibratory mechanism, the transverse cross-sectional dimensions of said vibrating shank being smaller than those of said vibratory mechanism;

a resilient stimulator element mounted at the free end of said shank, the longitudinal axis of the operative portion of said stimulator element extending outwardly from said vibratory mechanism in a direction approximately 135° to the longitudinal axis of said vibratory mechanism, said stimulator element having an extreme outer end having a conical shape to give said extreme end flexibility, the portion of said shank whose longitudinal axis coincides generally with the longitudinal axis of said vibratory mechanism having a transverse dimension, measured in a first plane containing the longitudinal axis of the operative portion of the stimulator element and the longitudinal axis of the vibratory mechanism in a direction normal to the longitudinal axis of the vibratory mechanism, that is approximately three times as large as the transverse dimension of said shank portion measured normal to said first plane, said shank being free of any other stimulator element facing said first mentioned stimulator element in opposed relationship thereto, whereby when said device is operated while being held in the user's hand the free end of said shank traces a generally elliptical path in a second plane perpendicular to the longitudinal axis of said vibratory mechanism, the major axis of said elliptical path being substantially perpendicular to said first mentioned plane.

* * * * *